US009835002B2

(12) United States Patent
Brown

(10) Patent No.: US 9,835,002 B2
(45) Date of Patent: Dec. 5, 2017

(54) DOWNHOLE APPARATUS AND ASSOCIATED METHODS

(71) Applicant: INTERWELL AS, Hafrsfjord (NO)

(72) Inventor: William Edmund Rolland Brown, Aberdeenshire (GB)

(73) Assignee: Interwell AS, Hafrsfjord (NO)

( * ) Notice: Subject to any disclaimer, the term of this patent is extended or adjusted under 35 U.S.C. 154(b) by 0 days.

(21) Appl. No.: 14/787,948

(22) PCT Filed: Apr. 30, 2014

(86) PCT No.: PCT/EP2014/058871

§ 371 (c)(1),
(2) Date: Oct. 29, 2015

(87) PCT Pub. No.: WO2014/177636

PCT Pub. Date: Nov. 6, 2014

(65) Prior Publication Data

US 2016/0069147 A1 Mar. 10, 2016

(30) Foreign Application Priority Data

May 2, 2013 (NO) ..... 20130608

(51) Int. Cl.

| | |
|---|---|
| ***E21B 23/00*** | (2006.01) |
| ***E21B 34/10*** | (2006.01) |
| ***E21B 34/08*** | (2006.01) |

(52) U.S. Cl.

CPC ..... *E21B 23/004* (2013.01); *E21B 23/006* (2013.01); *E21B 34/08* (2013.01); *E21B 34/10* (2013.01)

(58) Field of Classification Search

CPC ..... E21B 23/004; E21B 23/006; E21B 34/08; E21B 34/10

See application file for complete search history.

(56) References Cited

U.S. PATENT DOCUMENTS 5,335,731 A * 8/1994 Ringgenberg ..... E21B 23/006 166/264
2004/0084190 A1* 5/2004 Hill ..... E21B 23/006 166/386

(Continued)

FOREIGN PATENT DOCUMENTS

EP 0 594 393 A1 4/1994
GB 2 394 735 A 5/2004

(Continued)

OTHER PUBLICATIONS

International Search Report and Written Opinion dated Jan. 30, 2015 for PCT/EP2014/058871 filed on Apr. 30, 2014.

*Primary Examiner* — James G Sayre
(74) *Attorney, Agent, or Firm* — Oblon, McClelland, Maier & Neustadt, L.L.P.

(57) ABSTRACT

A method and downhole apparatus including a downhole indexer for cyclically varying a configuration or operational mode of a downhole tool according to a predetermined sequence. The apparatus includes tubular body, an indexing member, and a balance piston. The indexing member is selectively moveable relative to the tubular body between a first axial position and a second axial position in response to a signal. The balance piston supports the indexing member at the second position.

7 Claims, 6 Drawing Sheets

(56) References Cited

U.S. PATENT DOCUMENTS

| | | | | |
|---|---|---|---|---|
| 2010/0252276 | A1* | 10/2010 | Clausen | E21B 21/103 166/381 |
| 2010/0270034 | A1* | 10/2010 | Clausen | E21B 21/103 166/383 |
| 2011/0315390 | A1* | 12/2011 | Guillory | E21B 21/103 166/329 |

FOREIGN PATENT DOCUMENTS

| | | | |
|---|---|---|---|
| WO | 2009/067485 | A2 | 5/2009 |
| WO | 2013/034577 | | 3/2013 |

* cited by examiner

DOWNHOLE APPARATUS AND ASSOCIATED METHODS

FIELD

The present invention relates to apparatus and methods for use in controlling downhole tools; and, in particular though not exclusively, for use in cycling downhole tools between configurations or operational modes, such as with an indexing mechanism.

BACKGROUND

Downhole apparatus such as tools used in the exploration and production of hydrocarbon reserves often require remote activation or deactivation downhole. Sometimes the apparatus is toggled between different states or modes of operation using an indexing mechanism incorporated into a tool string. The indexing mechanism may be activated or toggled using a signal from surface, such as an electromagnetic signal, or a variation in fluid flow or pressure (e.g. caused by a drop-ball). Other activation mechanisms may follow a predetermined sequence according to other inputs, such as a time delay.

Typically the indexing mechanism will include a sleeve or a piston that can rotate and translate axially relative to a tubular, such as an inner or outer mandrel. The relative movement of the sleeve is often defined by a cam path, such as a slot and pin arrangement between the sleeve and the mandrel. Often the sleeve will transmit forces downhole, such as to open or close valves or reconfigure tools mechanically, such as by extending or retracting members with the movement of the sleeve.

SUMMARY

According to a first aspect of the invention there is provided a downhole indexing apparatus or indexer for cyclically varying a configuration or operational mode of a downhole tool according to a predetermined sequence, the apparatus comprising:

a tubular body;

an indexing member selectively moveable relative to the tubular body in response to a signal between two axial positions ; and a balance piston for supporting the indexing member at at least one of the axial positions.

The balance piston may be configured to move from a passive position to an active position to support the indexing member at the supported position. The indexing member may be selectively movable between a first axial position and a second axial position in response to the signal. The second position may comprise the supported position. The first position may comprise an unsupported position. The balance piston may be configured to move from the passive position to the active position when the indexing member moves from the first position to the second position. The balance piston may be configured to move from the passive position to the active position in response to the signal. The balance piston may be configured to move from the active position to the passive position when the indexing member moves from the second position to the first position. The balance piston may be configured to move from the active position to the passive position in response to a further signal.

The first position may comprise an initial or starting position.

Alternatively, the second position may comprise an initial or starting position.

The indexing member may be biased towards the second position by a biasing force.

The biasing force may propel the indexing member from the first position to the second position.

The biasing force may maintain the indexing member at the second position. The indexing member may be biased towards the second position by the biasing force at the second position. The biasing force may provide a preload, such as a pretension, at the second position, maintaining the indexing member in the second position.

The balance piston may be configured to at least partially counteract the biasing force when the indexing member is in the second position.

The balance piston may be configured to only partially counteract the biasing force when the indexing member is in the second position.

The balance piston may be configured to exert a counter-force proportional to the biasing force. The counter-force may be directly proportional to the biasing force. The counter-force may directly oppose the biasing force.

The balance piston may be configured to reduce the preload at the second position.

The biasing force may comprise a fluid pressure force component.

The biasing force may comprise a non-predetermined or an unintended or an unplanned or an unpredictable or an irregular biasing force component. The non-predetermined, unintended, unplanned, unpredictable or irregular biasing force component may comprise the fluid pressure force component. For example, the fluid pressure force component may comprise an external or annular fluid pressure force component, such as when running in a tool.

The balance piston may be configured to at least partially counteract the biasing force's fluid pressure force component.

The balance piston may be configured to exert a balance or counterforce on the indexing member similar in magnitude to the biasing force's fluid pressure force component.

The balance piston may be mechanically biased, such as towards the supported or second position.

The indexing member may be mechanically biased, such as towards the supported or second position.

The biasing force may comprise a mechanical force component. For example, the biasing force may comprise a spring force. The apparatus may comprise at least one resilient member for biasing the indexing member towards the second position from the first position. The resilient member may comprise a compression spring and/or a tension spring and/or a torsion spring. The resilient member may comprise a coil spring, a Bellevelle spring, a substantially solid member (e. g. an elastic ring), or the like.

The biasing force may comprise a predetermined or an intended or a planned or a predictable or a regular force component. The predetermined, intended, planned, predictable or regular force component may comprise the mechanical force component.

The balance piston's counterforce may comprise a fluid pressure force component.

The balance piston may be configured to engage or contact the indexing member at the second position. The balance piston may be configured to directly engage or contact the indexing member at the second position. The balance piston may be configured to indirectly engage or contact the indexing member at the second position; such as via an intermediate member/s or mechanism/s (e. g. a sleeve, piston, chamber, or the like).

The balance piston's counterforce may comprise a mechanical force component. For example, the balance piston's counterforce may comprise a spring force. The apparatus may comprise a resilient member for biasing the balance piston towards the active position from the passive position. The apparatus may comprise a resilient member for biasing the balance piston to support the indexing member at the second position. The resilient member may comprise a compression spring and/or a tension spring and/or a torsion spring. The resilient member may comprise a coil spring, a Bellevelle spring, a substantially solid member (e. g. an elastic ring), or the like.

The balance piston's counterforce may be less than the biasing force. The balance piston's mechanical counterforce component may be less than the biasing force's mechanical component, at least at the supported position.

The apparatus may be configured to expose the balance piston to a similar fluid pressure as the biasing force's fluid pressure. Accordingly, the magnitude of the counterforce exerted by the balance piston may be proportional, such as directly proportional, to the biasing force's fluid pressure component. The apparatus may be configured to expose the balance piston to a similar fluid pressure source as for the biasing force's fluid pressure component. The apparatus may be configured to propel the balance piston towards the active position and to propel the indexing member from the first position towards the second position with a similarly-pressurised fluid. The apparatus may be configured to propel the balance piston towards the active position and the indexing member from the first position towards the second position with the same fluid. The apparatus may be configured to propel the balance piston towards the active position and the indexing member from the first position towards the second position with fluid from the same source.

The apparatus may comprise a biasing fluid chamber for providing the biasing force fluid pressure component.

The apparatus may comprise a balance piston fluid chamber for providing the balance piston's fluid pressure counterforce component.

The biasing fluid chamber and the balance piston fluid chamber may be configured to be in fluid communication when in use.

The biasing and/or balance piston fluid chamber/s may be configured, in use, to be exposed to a fluid pressure without directly being exposed to the fluid pressure source (e. g. without the fluid of the fluid pressure source entering the chamber/s). The biasing and/or balance piston fluid chamber/s may be configured to be indirectly exposed to the fluid pressure source. Accordingly, contaminants and/or debris may be prevented from passing into the apparatus, such as entering into potentially contaminant or debris-sensitive parts of the apparatus, such as moving parts. For example, the biasing and/or balance piston fluid chamber/s may comprise an isolator for preventing or isolating or at least limiting or impeding fluid passage, such as into the apparatus or the biasing and/or balance piston fluid chamber/s. The isolator/s may separate the biasing and/or balance piston fluid chamber/s from the fluid of the fluid pressure source. The apparatus (e. g. the isolator and/or biasing and/or balance piston fluid chamber/s) may comprise a buffer fluid/s and/or a membrane/s or seal/s or the like for preventing or isolating or at least limiting or impeding fluid passage of the pressurising fluid from the fluid source (e. g. an external or annular fluid). The apparatus may be configured to substantially contain the buffer fluid. The apparatus may comprise a substantially constant volume of buffer fluid in the biasing and/or balance piston fluid chamber/s. The apparatus may comprise one or more external fluid chamber/s, such as between the biasing and/or balance piston fluid chamber/s and an external port. The apparatus may comprise a buffer piston/s. The biasing and/or balance piston fluid chamber/s may be separated from the external fluid by a buffer piston/s.

In use, the balance piston may be propelled from the passive position towards the active position by fluid pressure in the balance piston chamber.

In use, the indexing member may be propelled from the first position towards the second position by fluid pressure in the biasing fluid chamber.

In use, the balance piston chamber may be in fluid communication with an external fluid. In use, the balance piston chamber may be in fluid communication with a downhole fluid, such as an annular fluid.

In use, the biasing fluid chamber may be in fluid communication with an external fluid. In use, the biasing fluid chamber may be in fluid communication with a downhole fluid, such as an annular fluid.

In use, the balance piston chamber may be in fluid communication with the biasing chamber.

In use, the biasing fluid chamber may be in fluid communication with an internal fluid. In use, the biasing fluid chamber may be in fluid communication with a bore fluid. In use, the biasing fluid chamber may be in fluid communication with an uphole fluid. The apparatus may comprise a hydraulic source, such as via a hydraulic line, for pressurising the biasing fluid chamber.

In use, the balance piston chamber may be in fluid communication with an internal fluid. In use, the balance piston chamber may be in fluid communication with a bore fluid. In use, the balance piston chamber may be in fluid communication with an uphole fluid. The apparatus may comprise a hydraulic source, such as via a hydraulic line, for pressurising the balance piston fluid chamber.

The balance piston may comprise a similar effective area to the effective area under fluid pressure biasing the indexing member towards the second position.

The balance piston chamber may comprise a similar effective area to the biasing chamber's effective area.

The balance piston may comprise a smaller effective area than the effective area under fluid pressure biasing the indexing member towards the second position.

The balance piston chamber may comprise a smaller effective area than the biasing chamber's effective area.

The balance piston may comprise a greater effective area than the effective area under fluid pressure biasing the indexing member towards the second position.

The balance piston chamber may comprise a greater effective area than the biasing chamber's effective area.

The apparatus may comprise a biasing piston connected to the biasing chamber.

The indexing member may be connected to the biasing piston.

The indexing member may comprise the biasing piston. The indexing member may be the biasing piston.

The indexing member may comprise a cycle piston.

The balance piston may comprise a similar effective area to the effective area of the biasing piston.

The balance piston may comprise a smaller effective area than the biasing piston.

The balance piston may comprise a greater effective area than the biasing piston.

The indexing member may be biased or propelled in/towards a first direction by the biasing force; and biased or propelled in/towards a second direction by an indexing force. The first direction may be opposite to the second direction. For example, the biasing force may bias or propel the indexing member uphole, and the indexing force may bias or propel the indexing member downhole. The first direction may be from the first position towards the second position. The second direction may be from the second position towards the first position.

The first direction may be from the second position towards the first position. The second direction may be from the first position towards the second position.

The biasing piston may bias and/or propel the indexing member in/towards the second direction; at least when the indexing member is in the second position. The biasing piston may be mechanically biased.

The indexing force may be provided by a fluid pressure; and/or a mechanical force, such as a spring force. The indexing force may be provided by a bore pressure, such as an internal bore pressure.

The apparatus may comprise an indexing fluid chamber. The indexing and/or biasing and/or balance fluid chamber/s may comprise or be in fluid communication with a downhole fluid. For example, the indexing and/or biasing and/or balance fluid chamber/s may be in fluid communication with a bore fluid, such as an internal bore fluid within the tubular body. The indexing and/or biasing and/or balance fluid chamber/s may be in fluid communication with an external fluid, such as an annular fluid. The indexing and/or biasing and/or balance fluid chamber/s may be in fluid communication with an internal fluid. The indexing and/or biasing and/or balance fluid chamber/s may be in fluid communication with an external fluid. The indexing and/or biasing and/or balance fluid chamber/s may be in selective communication with a fluid. For example, the indexing and/or biasing and/or balance fluid chamber/s may be selectively connected to an internal fluid and/or an external fluid. The indexing and/or biasing and/or balance fluid chamber/s may be in selective communication with a fluid The indexing and/or biasing and/or balance fluid chamber/s may comprise a/respective port/s. The apparatus may be configured to generate a/respective pressure difference/s across the/each port/s. The pressure difference across the port may allow for a different pressure in the indexing and/or biasing and/or balance fluid chamber/s from a fluid source. For example, pressure in a chamber may be less than a bore fluid pressure, such as due to a pressure drop across a port into/out of said chamber. The/each chamber may comprise at least one inlet port and/or outlet port.

The indexing member may be movable to a third axial position. The indexing member may be selectively moveable relative to the tubular body between the second axial position and the third axial position in response to a signal. The indexing member may be selectively moveable from the second axial position to the third axial position via an intermediate or fourth position. The fourth position may comprise and/or correspond to the first axial position. For example, the fourth position may correspond to the first axial position with the indexing member rotated relative to the first axial position. The indexing member may be moveable from the first axial position to the third axial position. The fourth position may comprise a fourth axial position; distinct from the first and/or second and/or third axial positions.

The first axial position may be proximal to the second axial position. The first and/or second axial position/s may be distal to the third axial position.

The indexing member may be selectively moveable from the first (and/or fourth) axial position to either the second or third axial position. The indexing member may be selectively moveable from the first (and/or fourth) axial position to either the second or third axial position according to a predetermined sequence. The predetermined sequence may be cyclical. The predetermined sequence may be repeating. The predetermined sequence may be infinitely or endlessly repeating.

The second or supported position may comprise an intermediate position. The second position may be axially positioned between the first and third axial positions.

The balance piston may be configured to support the indexing member at any intermediate axial position. Alternatively, the balance piston may be configured to only support the indexing member at one or selected intermediate axial position/s.

The provision of a balance piston to support the indexing member at an intermediate position may allow for an increased functionality of the apparatus. The apparatus may be configured to provide an increased functionality of the indexing member at an intermediate axial position. The balance piston may allow for increased forces, such as increased forces transmitted via the indexing member at the intermediate position. The support of the indexing member by the balance piston at the intermediate position may allow for an increased pressure or increased pressure differential when the indexing member is at the intermediate position. For example, compared to a corresponding apparatus without a balance piston, the indexing member may be exposable to higher fluid pressure, such as higher internal bore fluid pressure, in the intermediate position. The balance piston may be configured to prevent a transfer of high or excessive forces to the coupling arrangement. The balance piston may be configured to protect the coupling arrangement at least at the intermediate axial position. The provision of the balance piston may enable the indexing member and/or coupling arrangement to be exposed to higher pressure and/or pressure differentials and/or pressure changes, such as for prolonged periods, in the intermediate position. Enabling the indexing member to be exposed to a higher pressure in the intermediate axial position may allow the apparatus to be used for additional or alternative operations. For example, the apparatus may be configured to operate at a maximum fluid pressure in one or more end axial position/s (e. g. uppermost and/or lowermost; first and or third axial position/s) and/or the intermediate axial position. The supported intermediate position may allow for additional or alternative configurations or operational states at a higher fluid pressure, such as an additional active or passive operating state of the apparatus. Accordingly, additional or alternative tools, valves or member may be selectively actuated, such as when the indexing member is in one or more intermediate axial positions. For example, the apparatus may be configured to actuate a first downhole tool at the first intermediate position; and configured to actuate a second downhole tool at a second intermediate position or at an axial end position. The apparatus may be configured to index a plurality of tools and/or downhole members (e. g. a valve, port or the like). For example, the apparatus may allow the selective actuation of two tools simultaneously and/or independently and the selective deactuation of the two tools simultaneously and/or independently. The apparatus may be configured to provide an ON configuration at the intermediate axial position (e. g. ON for a fluid-operated or actuated tool, or a tool to be operated in conjunction with a high internal fluid pressure). The apparatus may be configured to provide a selective ON configuration at the intermediate axial position.

The apparatus may comprise a stop for limiting movement of the indexing member. For example, the apparatus may comprise a projection in the axial path of the indexing member; such as a shoulder, a flange, a pin, and/or the like. The stop may be configured to reduce a load on the coupling arrangement. For example, the stop may be positioned to support the indexing member at a particular axial position.

The apparatus may comprise a first stop (e. g. a bottom or top stop) corresponding to the first axial position of the indexing member. The apparatus may comprise a second stop (e. g. a top or bottom stop) corresponding to the third axial position.

The apparatus may comprise a coupling arrangement for controlling movement of the indexing member.

The coupling arrangement may be between the indexing member and the tubular body.

The coupling arrangement may comprise a pair of inter-engaging clutch members.

The coupling arrangement may comprise a cam member and a cam follower member.

The coupling arrangement may define a path for the relative axial and/or rotational movement of the indexing sleeve with respect to the tubular body.

The coupling arrangement may comprise a protrusion and a slot, wherein the protrusion engages the slot. The slot may comprise a continuous circumferential slot. The protrusion may comprise a pin, such as a guide pin. The protrusion may comprise a series of protrusions. The cam member may comprise the slot; and the cam follower may comprise the protrusion (or vice versa). The protrusion/s may be inwardly-oreinted (e. g. protruding radially inwardly, such as towards a centre of the apparatus).

The slot may provide a loose fit between the protrusion and walls of the slot; at least at one or more particular positions; such as corresponding to the first and/or second and/or third and/or fourth axial position/s of the indexing member. The slot may provide a clearance between the protrusion and walls of the slot; at least at one or more particular positions; such as corresponding to the first and/or second and/or third and/or fourth axial position/s of the indexing member. The clearance may be increased at at least one or more particular positions; such as corresponding to the first and/or second and/or third and/or fourth axial position/s of the indexing member.

The coupling arrangement may be configured to allow the indexing member to be supported by a stop at one or more positions. The coupling arrangement may be configured to allow the indexing member to be supported by a stop at one or more end axial position/s (e. g. uppermost and/or lowermost). The coupling arrangement may be configured to allow the indexing member to be supported by a stop at one or more intermediate axial positions.

The slot may be configured to allow the indexing member to engage and/or contact a stop at the first and/or second and/or third and/or fourth axial position/s. The slot may be configured to allow a stop to support at least at a portion of the biasing force and/or indexing force and/or counterforce at the first and/or second and/or third and/or fourth axial position/s.

The coupling arrangement may be configured to allow the balance piston to support the indexing member at one or more positions. The coupling arrangement may be configured to allow the indexing member to be supported by the balance piston at one or more intermediate axial positions. The coupling arrangement may be configured to allow the indexing member to be supported by the balance piston at one or more end axial position/s (e. g. uppermost and/or lowermost).

The slot may be configured to allow the indexing member to engage and/or contact the balance piston at the first and/or second and/or third and/or fourth axial position/s. The slot may be configured to allow the balance piston to support at least at a portion of the biasing force and/or indexing force and/or counterforce at the first and/or second and/or third and/or fourth axial position/s.

The balance piston may be configured to reduce a load, such as the biasing force, acting on the coupling arrangement; at least at the second axial position.

The provision of the balance piston may protect the coupling arrangement from high loads, at least at the supported or second position. The provision of the balance piston may protect the coupling arrangement from high loads at one or more intermediate axial position/s. The provision of the balance piston may permit an improved coupling arrangement. For example, the balance piston may permit a reduced strength and/or alternative configuration and/or number of protrusions, such as guide pins. Accordingly, alternative indexing members, such as with an increased number of indexing positions and/or an increased variety of types of indexing position, may be possible. The balance piston may provide an increased safety margin. The provision of the balance piston may provide an increased robustness. The balance piston may permit an increased number of intermediate axial positions.

The indexing member may comprise the cam follower. The tubular body may comprise the cam member.

Alternatively, the indexing member may comprise the cam member. The tubular body may comprise the cam follower.

The slot may extend at least partially through the indexing member or the tubular body.

The slot may define a cycle having at least three sequential indexing positions around the circumference of the indexing member, each indexing position corresponding to an operational state or configuration of the downhole tool.

At least two sequential indexing positions of the indexer may correspond to the same operational state or configuration.

At least two sequential indexing positions of the indexer may correspond to different operational states or configurations.

The indexer may comprise a plurality of indexing pins and an indexing sleeve having a continuous slot formed around a circumference thereof, wherein the indexing pins engage the slot. For each of the indexing pins, the slot may define a cycle of at least two sequential indexing positions, wherein the cycles are identical and extend consecutively around the circumference of the indexing sleeve. For each of the indexing pins, the slot may define a cycle of at least three sequential indexing positions, wherein the cycles are identical and extend consecutively around the circumference of the indexing sleeve. The use of a plurality of indexing pins in this way may provide a more robust indexing mechanism.

The coupling arrangement may comprise a discontinuous slot. The coupling arrangement may be configured to be rotationally reversed to cycle between states, operational modes or configurations. For example, the indexing member may be configured to rotate relative to the tubular body in a clockwise direction to toggle the apparatus from a first configuration to a second configuration (or vice versa). The indexing member may be configured to rotate relative to the tubular body in a counter-clockwise direction to toggle the apparatus from the second configuration to the first configuration (or vice versa).

The indexer may be configured to provide a reduced load on an indexer member, such as an indexing guide pin, or the like. The balance piston may be configured to provide a reduced load on an indexer member; such as an indexing guide pin, or the like.

The balance piston may be configured to provide a reduced load on the coupling arrangement.

The support of the balance piston at the second position may permit a reduction in the specification and/or strength and/or number and/or tolerances of protrusions. For example, the support of the balance piston may reduce a load on the indexing pins in the intermediate position. Reducing a load on a protrusion (e. g. for a similar pressure or pressure difference) may enable a reduced number of guide pins to be used. Reducing the number of guide pins required may enable alternative configurations of indexing: for example, where a reduced number of pins is provided around a circumference, the indexing pattern is repeated less (corresponding to the number of guide pins). Accordingly, a relatively increased proportion of the circumference of the indexing member may be utilised to define an indexing pattern. Accordingly, more complex indexing patterns, or indexing patterns with more steps between cycles or repetitions may be enabled.

The balance piston may provide a similar function in the intermediate position as the stop/s in the respective first and third axial positions (e. g. top and bottom). Accordingly, the balance piston's support at the intermediate position may ensure that loading on the protrusion/s and or slot/s is reduced/low.

The tubular body may comprise a sleeve or a mandrel or a housing, or the like.

The tubular body may comprise an outer tubular body. For example, the tubular body may be radially outwardly disposed of the indexing member. The indexing member may be mounted in the tubular body.

The tubular body may comprise an inner tubular body. For example, the tubular body may be radially inwardly disposed of the indexing member. The tubular body may be mounted in the indexing member.

The indexing member may comprise a sleeve or a mandrel or a housing, or the like.

The indexing member may comprise an inner sleeve. The indexing member may be radially inwardly disposed of the tubular body. The indexing member may be mounted within the tubular body.

The indexing member may comprise an outer sleeve. The indexing member may be radially outwardly disposed of the tubular body. The tubular body may be mounted within the indexing member.

The apparatus may comprise a second tubular body. The second tubular body may be radially disposed on an opposite side of the indexing member and/or balance piston relative to the first tubular body. The second tubular body may comprise a sleeve or mandrel, or the like. For example, the second tubular body may comprise an inner mandrel. The second tubular body may define the chamber/s; such as between the first and second tubular bodies. The first and second tubular bodies may be integrally formed. The first and second tubular bodies may be discrete.

The signal may comprise a change in fluid pressure. The signal may comprise a change in a differential fluid pressure acting across the indexing member. The fluid may comprise a liquid. The fluid may comprise a gas. The fluid may comprise a multi-phase fluid. The signal may comprise a change in fluid phase. The signal may comprise a change in flow rate. The signal may comprise a drop-ball, a plug; a dart; an electromagnetic signal; an RFID tag; and/or a variation in fluid flow or pressure; or the like.

The indexer may be activated or toggled using a signal from surface.

The indexer may comprise a fluid-responsive or fluid-actuated indexer. The indexer may comprise a fluid pressure-responsive or fluid pressure-actuated indexer. The indexer may comprise a fluid flow-responsive or fluid flow-actuated indexer.

The apparatus may comprise the downhole tool. For example, the apparatus may comprise a valve or a selectable flow restriction; the valve or selectable flow restriction being reconfigurable or variable between operational states.

The downhole tool may comprise the indexer.

The downhole tool may be distinct from the apparatus. The downhole tool may be connectable to the apparatus. Alternatively, the downhole tool may be integral with the apparatus.

The apparatus may be configured to index a variety of downhole tools. The apparatus may be configured to mount in a toolstring, suitable for activating a multiplicity of downhole tools. The apparatus may be interchangeably mountable with a variety of downhole tools.

The indexer may comprise the downhole tool.

The downhole tool may comprise a packer, a plug, a bridge plug, a straddle, a perforation gun, a slip, a gripping element, an injector, a flow control device, a valve, a reamer, an under reamer, a stabiliser for stabilising an under reamer, a centraliser, a cutter, a drill, a directional drilling mechanism, and/or the like.

The indexer may be rotatable relative to the tubular body.

According to a second aspect of the invention there is provided a method for cyclically varying a configuration or operational mode of a downhole tool according to a predetermined sequence, the method comprising:

transmitting a signal to selectively move an indexing member relative to a tubular body between two axial positions; and supporting the indexing member at at least one of the axial positions with a balance piston.

The indexing member may be selectively movable between a first axial position and a second axial position in response to the signal. The second position may comprise the supported position. The first position may comprise an unsupported position.

The method may further comprise transmitting a further signal to selectively move the indexing member relative to the tubular body to a third axial position.

The second position may comprise an intermediate axial position, between the first and third axial positions.

According to a further aspect of the invention there is provided a downhole apparatus for cyclically varying a configuration or operational mode of a downhole tool according to a predetermined sequence, the apparatus comprising:

a tubular body;

an actuation piston or sleeve mounted in the tubular body and selectively axially moveable in the tubular body between a first axial position and a second axial position in response to a biasing force;

a counter-piston configured to at least partially counteract the biasing force at least when the actuation piston is in the second position.

According to a further aspect of the invention there is provided a downhole apparatus for cyclically varying a configuration or operational mode of a downhole tool according to a predetermined sequence, the apparatus comprising:

a tubular body;

an actuation piston or sleeve mounted in the tubular body and selectively axially moveable in the tubular body between a first axial position and a second axial position in response to a biasing force;

a counter-piston configured to at least partially counteract the biasing force at least when the actuation piston is in the second position.

The actuation piston may comprise an indexing sleeve.

The counter-piston may comprise a balance piston.

According to a further aspect of the invention there is provided a downhole apparatus for cyclically varying a configuration or operational mode of a downhole tool according to a predetermined sequence, the apparatus comprising:

an actuation member selectively movable from a first axial position corresponding to a first configuration or operational mode of the downhole tool to a second axial position corresponding to a second configuration or operational mode of the downhole tool when subjected to a selected biasing force;

a support member configured to provided an active support force to the actuation member in the second position to at least partially counteract the biasing force, wherein the active support force is proportional to the biasing force.

The active support member may comprise a piston. The active support member may comprise a counter-piston. The active support member may comprise a balance piston.

The actuation member may comprise a piston or sleeve.

The apparatus may comprise an indexing mechanism.

The apparatus may comprise a fluid-responsive actuation apparatus.

The selected biasing force may comprise at least a force component associated with a fluid pressure differential acting across the actuating member. The biasing force may comprise a fluid pressure component. For example, the biasing force may comprise a force component of a downhole and/or annular fluid pressure.

The active support force may be proportional to the fluid pressure differential acting across the actuating member.

The biasing force may comprise a mechanical or spring force component. For example, the apparatus may comprise a resilient element, such as a spring, elastic member, or the like.

The provision of the support member may allow the apparatus to be reconfigurable between at least three configurations. For example the second position of the actuation member may comprise an intermediate position. The actuation member may be selectively movable to a third position.

The actuation member may be longitudinally movable, such as axially coincident with a longitudinal axis of the downhole tool (e. g. movable uphole/downhole).

The actuation member may be configured to move between a first position or configuration corresponding to a first pressure differential and a second position or configuration corresponding to a second fluid pressure differential; and to a third position or configuration corresponding to the first pressure differential.

The actuation member may comprise a piston or a sleeve, or the like.

According to a further aspect of the invention there is provided a downhole apparatus for cyclically varying a configuration or operational mode of a downhole tool according to a predetermined sequence, the apparatus comprising:

an actuation member selectively movable from a first axial position corresponding to a first configuration or operational mode of the downhole tool to a second axial position corresponding to a second configuration or operational mode of the downhole tool when subjected to a selected biasing force;

a support member configured to provided an active support force to the actuation member in the second position to at least partially counteract the biasing force, wherein the active support force is proportional to the biasing force.

According to a further aspect of the invention, there is provided a method of cyclically varying a configuration or operational mode of a downhole tool according to a predetermined sequence comprising:

selectively activating a biasing force to selectively move an actuation member from a first axial position corresponding to a first configuration or operational mode of the downhole tool to a second axial position corresponding to a second configuration or operational mode of the downhole tool; and providing an active support force to the actuation member in the second position with an active support member to at least partially counteract the biasing force, wherein the active support force is proportional to the biasing force.

The active support force may be provided by a balance piston.

A method of cyclically varying an operational mode or position or configuration of a fluid responsive downhole indexing mechanism, the method comprising:

exposing an actuation member at a first axial position to a first fluid pressure from a first fluid pressure source;

exposing the actuation member at the first position to a second fluid pressure differential to move the actuation member to a second axial position;

exposing a balance piston to an inverse of the second fluid pressure differential to support the actuation member at the second position.

The invention includes one or more corresponding aspects, embodiments or features in isolation or in various combinations whether or not specifically stated (including claimed) in that combination or in isolation. For example, it will readily be appreciated that features recited as optional with respect to the first aspect may be additionally applicable with respect to the other aspects without the need to explicitly and unnecessarily list those various combinations and permutations here (e. g. the indexer of one aspect may comprise features of any other aspect). Optional features as recited in respect of a method may be additionally applicable to an apparatus; and vice versa. For example, an apparatus may be configured to perform any of the steps or functions of a method.

In addition, corresponding means for performing one or more of the discussed functions are also within the present disclosure.

It will be appreciated that one or more embodiments/aspects may be useful in selectively actuating a downhole tool, such as selectively actuating a bridge plug.

The above summary is intended to be merely exemplary and non-limiting.

BRIEF DESCRIPTION OF THE DRAWINGS

The present invention will now be described by way of non-limiting example only with reference to the following drawings of which.

DETAILED DESCRIPTION OF THE DRAWINGS

Figure 1:
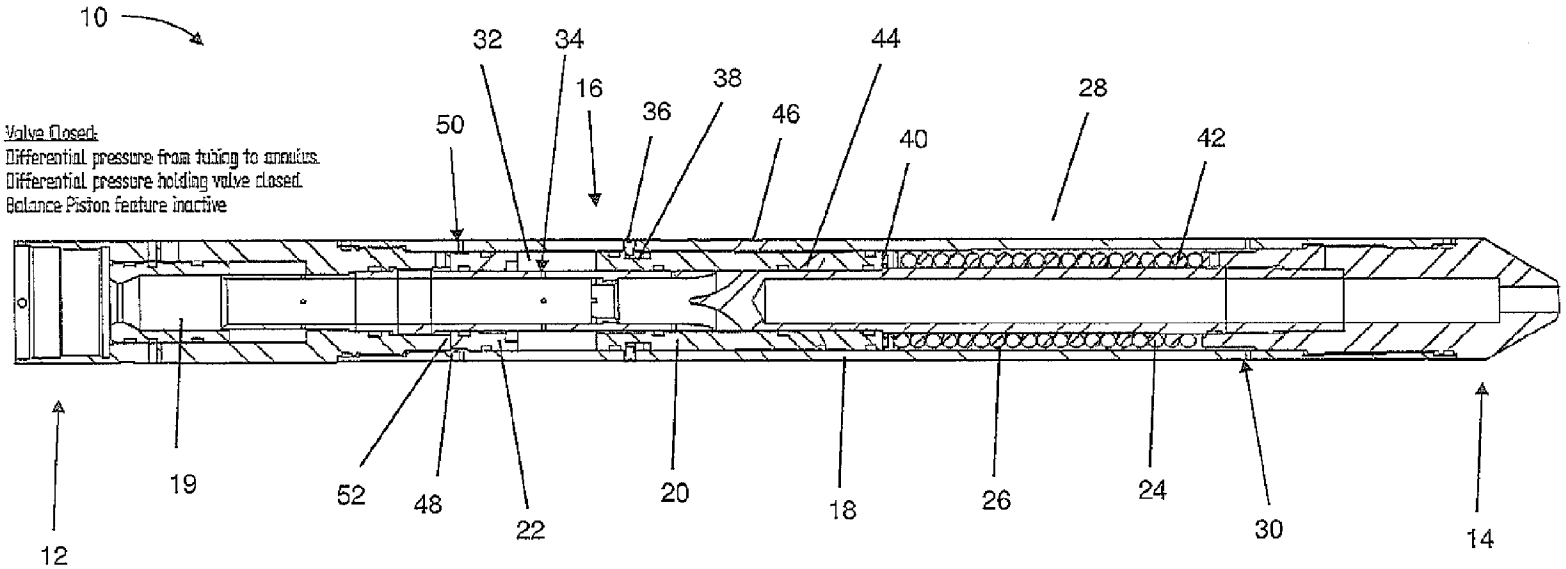
FIG. 1 is a schematic illustration of an indexer with an indexing member and a balance piston, with the indexing member in a first position.

Referring initially to FIG. 1 there is shown a portion of tool string generally designated 10 comprising an uphole end 12 and a downhole end 14. The tool string 10 includes an indexing apparatus 16 with a tubular body 18 having a throughbore 19, an indexing member 20, and a balance piston 22. It should be understood that references to a particular direction or orientation such as "down", "up", "upper", "lower", "above", "below", "side" and the like used throughout the following description apply to a vertical orientation of the tool string 10 and are not intended to be limiting in any way. For example, the tool string 10 may be utilised in vertical, deviated and/or horizontal wellbores.

In the embodiment shown, the indexing member 20 is in the form of a sleeve, mounted coaxially within the tubular body 18. The indexing member 20 is axially moveable within the tubular body 18, acting as a cycling biasing piston. The apparatus 16 has a compression spring 24 biasing the indexing member 20 uphole. In addition, an annular biasing chamber 26 is defined downhole of the indexing member 20, also biasing the indexing member 20 uphole. The annular biasing chamber 26 is sealed from the throughbore 19, and in fluid communication with an annulus 28 external to the apparatus 16 (such as between the tool string 10 and a casing or bore wall, not shown) via a biasing chamber port 30. Fluid pressure in the biasing chamber 26 corresponds generally to the annular fluid pressure and acts on a lowermost effective area of the indexing member 16 to force the indexing member 16 uphole.

Uphole of the indexing member 20 is an indexing fluid chamber 32. The indexing fluid chamber 32 acts on an uppermost effective area of the indexing member 16 to force the indexing member 16 downhole. The indexing fluid chamber 32 is in fluid communication with the throughbore 19 via an indexing chamber port 34; and sealed from the annulus 28 and the biasing fluid chamber 26. In the embodiment shown, the uppermost and lowermost effective areas of the indexing member 16 are similar, such that when throughbore and annular fluid pressure are similar, the net resultant force on the indexing member 16 is the mechanical uphole biasing force of the compression spring 24. However, in the configuration shown in FIG. 1, the throughbore pressure is substantially greater than the annular pressure. Accordingly, the downhole biasing force generated in the indexing fluid chamber 32 is substantially greater than the uphole biasing force of the combination of the mechanical spring 24 and the biasing fluid chamber 26. Accordingly, the apparatus is shown in FIG. 1 with the indexing member 20 in a first axial position, which is a lowermost axial position in the embodiment shown.

The movement of the indexing member 20 relative to the tubular body 18 is defined by a guide pin 36 and slot 38 coupling arrangement. The guide pins 36 are mounted to project radially internally from the tubular body 18; and the slot 38 is formed as a radially inwardly extending recess in the indexing member 20, extending around the circumference of the indexing member 20 as a continuous recess.

In the configuration shown in FIG. 1, the net downhole biasing force (resultant from the greater downhole indexing fluid chamber biasing force compared to the uphole spring and biasing chamber fluid force) propels the indexing member 20 to a lowermost position defined by the pin 36 and slot 38 arrangement. In the embodiment shown, when the indexing member 20 reaches the first position of FIG. 1, the indexing member is supported on a lower stop 40, formed as a shoulder on an inner mandrel 42 that defines the biasing chamber 26 inside the tubular body 18. The lower stop ensures that once the indexing member 20 reaches the first position if FIG. 1, a portion of the downhole net biasing force is diverted from the pin 36 and 38 slot coupling arrangement. Accordingly, higher forces, such as due to increased throughbore pressures, may be permissible, without overloading the coupling arrangement.

The balance piston 22 is shown in an inactive or passive position in FIG. 1. The balance piston 22 is biased uphole by fluid pressure in the indexing chamber 32, which exceeds annular pressure in the configuration shown in FIG. 1. Accordingly the downhole balance piston biasing force generated in a balance piston chamber 48 is less than the uphole balance piston biasing force generated in the indexing chamber 32, which is in fluid communication with the annulus 28 via a balance piston chamber port 50. The balance piston 22 is pressed uphole to the passive position, where it is supported by an upper stop 52.

In the embodiment shown, the indexing member 20 comprises an indexing port 44 (partially shown in FIG. 1) for selectively communicating with a port or valve 46 in the tubular body 18. The first position of FIG. 1 corresponds to a valve closed position. In FIG. 1, the body port 46 is actively maintained closed by an internal bore pressure, such as provided from above (e. g. by a pump).

When it is desired to reconfigure the apparatus 16, a signal is transmitted in the form of a decrease in fluid pressure in the throughbore 19. For example, fluid pressure generated by pumping fluid from surface may be decreased, such as by decreasing pumping rate or pressure. Accordingly, fluid pressure in the indexing chamber 32, in fluid communication with the throughbore 19 via the indexing chamber port 34, decreases. When the downhole biasing force acting on the indexing member 20 generated in the indexing chamber 32 falls below the combined mechanical and biasing fluid chamber uphole biasing force acting on the indexing member 20, the indexing member is propelled from the first position of FIG. 1 to the supported or second position of FIG. 2.

When the uphole biasing force acting on the balance piston 22 generated in the indexing chamber 32 falls below the downhole biasing force acting on the balance piston generated in the balance piston chamber 48, which is in fluid communication with the annulus 28 via the balance piston port 50, the balance piston is propelled downhole towards the indexing member. When the indexing member 20 reaches the end of its uphole cycle travel as defined by the guide pin 36 and slot 38 coupling arrangement, the indexing member 20 is engaged by the balance piston 22. The balance piston 22 exerts a downhole force on the indexing member 20. The effective area of the balance piston 22 acting downhole is similar to the effective area in the biasing fluid chamber acting uphole (and also to the effective downhole and uphole areas of the indexing fluid chamber). Accordingly, the balance piston 22 substantially counter-acts or balances the entire fluid-generated uphole force component acting on the indexing member 20. Accordingly, the indexing member 20 is effectively biased against the guide pins 36 in the second position only by the compression spring 24. Accordingly, the apparatus 16 may be suitable for higher fluid pressures and fluid pressure differentials than may otherwise be possible. For example, the throughbore pressure may be negligible, such as when the toolstring 10 is run-in, such that the apparatus 16 may be safely exposed in the second position to a substantially greater annular than throughbore pressure.

In other embodiments it will be appreciated that the indexing member may be additionally or alternatively biased by a motor/s and/or a hydraulic ram/s, or the like.

Figure 2:
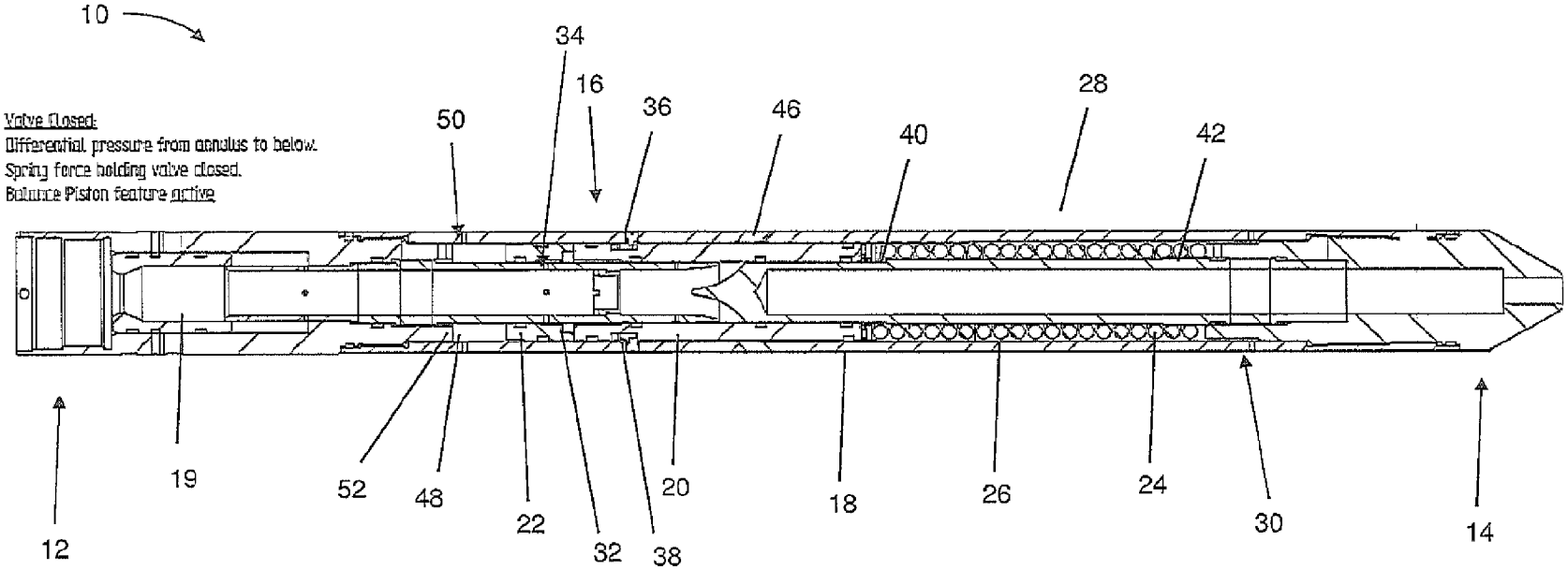
FIG. 2 is a schematic illustration of the indexer of FIG. 1 with the indexing member in a second position, with the indexing member and balance piston engaged.

The balance piston 22 effectively functions as an intermediate stop supporting the indexing member 20 in the second position of FIG. 2.

In the embodiment shown, the second position of FIG. 2 corresponds to a similar operational state as the first position. That is, the second position corresponds to a valve closed position. In FIG. 2, the body port 46 is passively maintained closed by the biasing, such as provided from the spring 24 and biasing fluid chamber 26 pressurised by the annular 28 fluid pressure. However, it will readily be appreciated that in alternative embodiments, the second position may correspond to a different operational state (e. g. a valve open position).

When it is desired to reconfigure the apparatus 16 again, fluid pressure in the throughbore 19 is increased. For example, fluid pressure generated by pumping fluid from surface may be increased, such as by increasing pumping rate or pressure. Accordingly, fluid pressure in the indexing chamber 32, in fluid communication with the throughbore 19 via the indexing chamber port 34, increases. When the downhole biasing force acting on the indexing member 20 generated in the indexing chamber 32 rises above the combined mechanical and biasing fluid chamber uphole biasing force acting on the indexing member 20, the indexing member is propelled from the second position of FIG. 2 to the third position of FIG. 3.

When the uphole biasing force acting on the balance piston 22 generated in the indexing chamber 32 rises above the downhole biasing force acting on the balance piston generated in the balance piston chamber 48, which is in fluid communication with the annulus 28 via the balance piston port 50, the balance piston is propelled uphole towards the stop 52.

When the indexing member 20 reaches the end of its downhole cycle travel as defined by the guide pin 36 and slot 38 coupling arrangement, the indexing member 20 reaches the first position of FIG. 1, the indexing member is supported on a lower stop 40, formed as a shoulder on an inner mandrel 42 that defines the biasing chamber 26 inside the tubular body 18. The lower stop ensures that once the indexing member 20 reaches the first position if FIG. 1, a portion of the downhole net biasing force is diverted from the pin 36 and 38 slot coupling arrangement. Accordingly, higher forces, such as due to increased throughbore pressures, may be permissible, without overloading the coupling arrangement.

Figure 3:
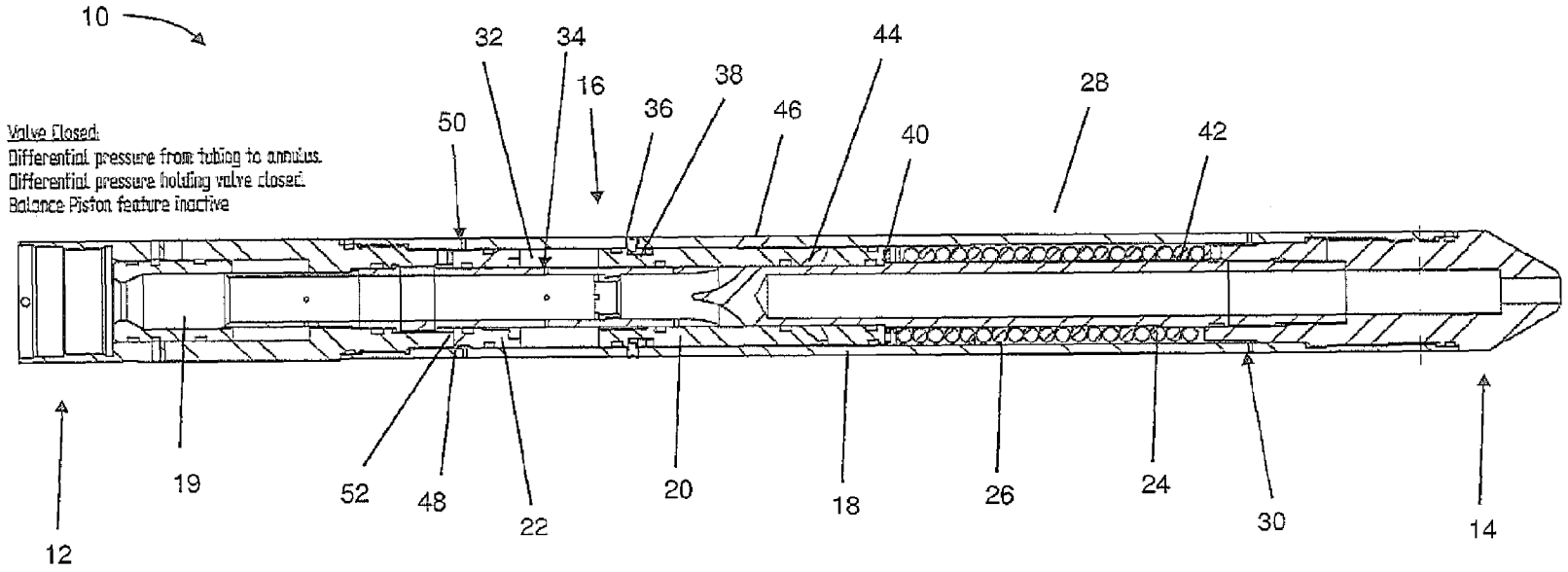
FIG. 3 is a schematic illustration of the indexer of FIG. 1 in a third position.

In the embodiment shown, the third position of FIG. 3 corresponds to a similar axial position and operational state as the first position. That is, the third position corresponds to a valve closed position. In FIG. 3, the body port 46 is actively maintained closed by an internal bore pressure, such as provided from above (e. g. by a pump). However, it will readily be appreciated that in alternative embodiments, the third position may correspond to a different axial position (e. g. a second intermediate axial position) and/or a different operational state (e. g. a valve open position).

When it is desired to reconfigure the apparatus 16, such as to cycle the apparatus 16 to a valve open position, fluid pressure in the throughbore 19 is decreased. For example, fluid pressure generated by pumping fluid from surface may be decreased, such as by decreasing pumping rate or pressure. Accordingly, fluid pressure in the indexing chamber 32, in fluid communication with the throughbore 19 via the indexing chamber port 34, decreases. When the downhole biasing force acting on the indexing member 20 generated in the indexing chamber 32 falls below the combined mechanical and biasing fluid chamber uphole biasing force acting on the indexing member 20, the indexing member is propelled from the third position of FIG. 3 (corresponding to the first axial position of FIG. 1) to the fourth position of FIG. 4.

When the indexing member 20 reaches the end of its uphole cycle travel as defined by the guide pin 36 and slot 38 coupling arrangement, the indexing member 20 engages the balance piston 22. The balance piston 22 exerts a downhole force on the indexing member 20. The effective area of the balance piston 22 acting downhole is similar to the effective area in the biasing fluid chamber acting uphole (and also to the effective downhole and uphole areas of the indexing fluid chamber). The balance piston 22 substantially counter-acts or balances the entire fluid-generated uphole force component acting on the indexing member 20; although the indexing member 20 is effectively biased against the guide pins 36 in the fourth position by the mechanical spring 24. Furthermore, the indexing member 20 is supported by the stop 52 via the balance piston 22.

Figure 4:
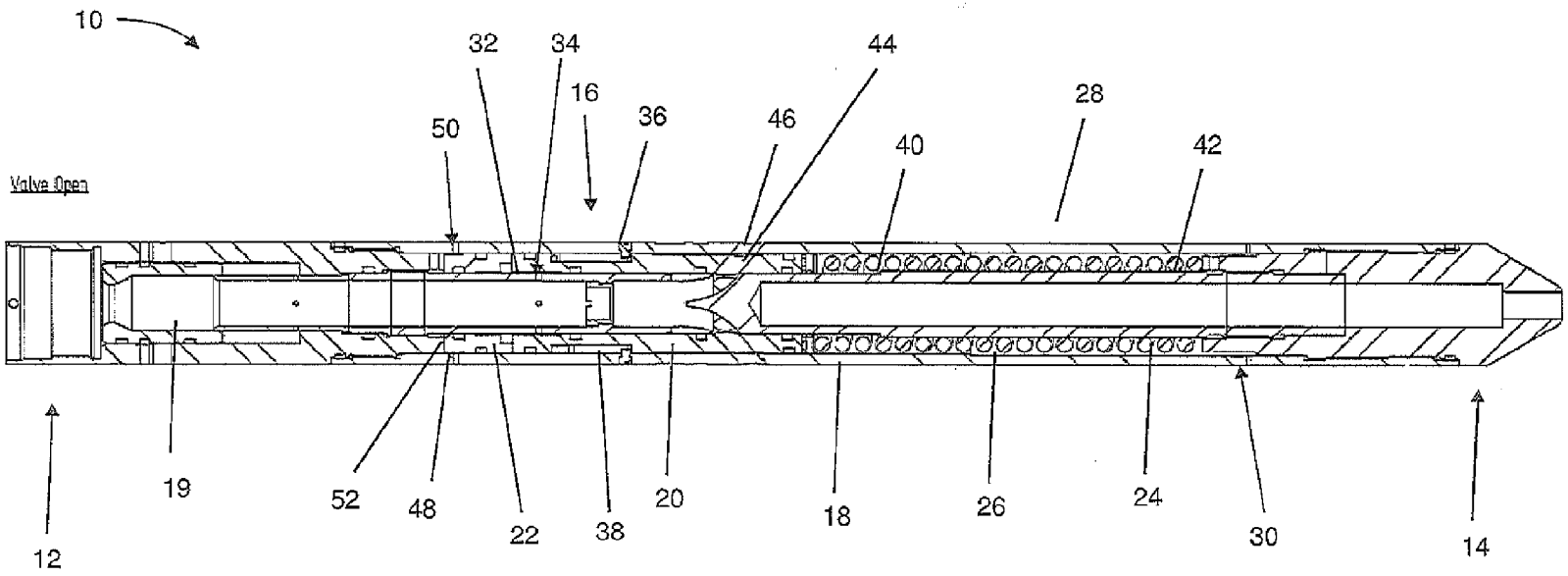
FIG. 4 is a schematic illustration of the indexer of FIG. 1 in a fourth position.

In the embodiment shown, the fourth position of FIG. 4 corresponds to a different operational state as the first position. That is, the fourth position (third different axial position) corresponds to a valve open position. The body port 46 and indexing port 44 are rotationally and axially aligned. However, it will readily be appreciated that in alternative embodiments, the fourth position (third different axial position) position may correspond to a different operational state (e. g. a valve closed position).

It will readily be appreciated that the apparatus 16 may be endlessly cycled or indexed between the configurations of FIGS. 1 to 4, sequentially. That is the apparatus 16 can be reconfigured from that of FIG. 4 to FIG. 1, such as by decreasing pressure in the indexing fluid chamber 32.

Figure 5:
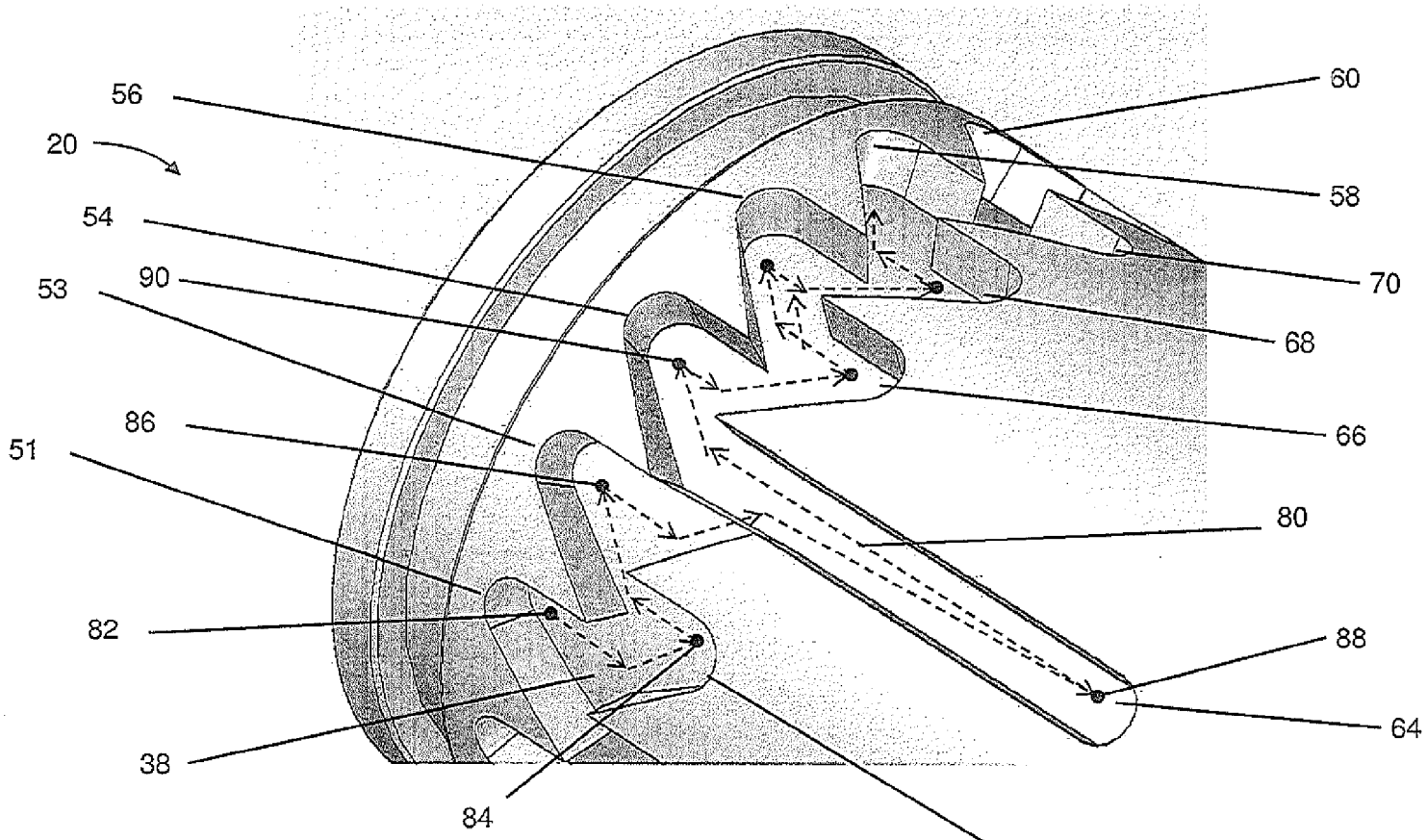
FIG. 5 is a schematic view of a portion of the indexing member of FIG. 1.
Figure 6:
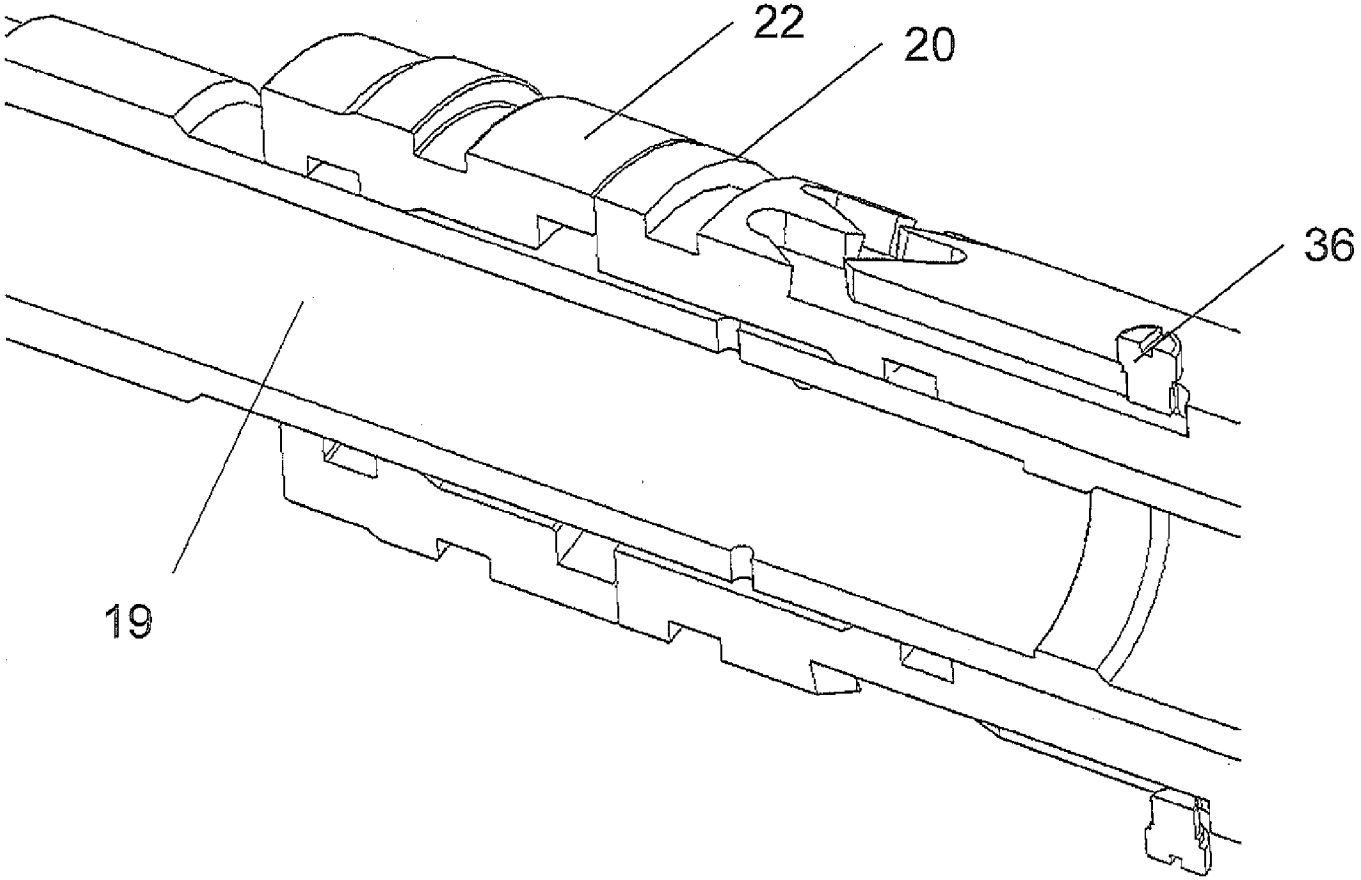
FIG. 6 is a schematic view of a portion of the balance piston of FIG. 1.

Reference is now made to FIG. 5, which shows the relative movement of the guide pin 36 in the slot 38 between respective positions; although in the embodiment shown it will be appreciated that the guide pin 36 remains substantially static and the indexing member 20 with slot 38 moves relative to the guide pin 36 (i. e. the indexing member 20 rotates and translates relative to the tubular body 18 along the path 80 shown relative to the guide pin 36). In the embodiment shown, the slot 38 extends continuously around a circumference of the indexing member 20. The profile of the slot 38 defines a cyclical sequence corresponding to the axial positions of FIGS. 1 to 4. The cyclical sequence has three axial indexing positions within each cycle, wherein each indexing position corresponds to an operational state or configuration.

In use, the indexing member is used to control the operational state or configuration of downhole apparatus.

The slot 38 defines a series of peaks 51, 53, 54, 56, 58, 60. In the embodiment shown, all of the peaks correspond to a similar axial position (lowermost) of the indexing member 20 relative to the tubular body 18. However, it will readily be appreciated that variations in peak axial positions may be comprised within other embodiments.

Circumferentially positioned between each peak 51, 53, 54, 56, 58, 60 is a trough 62, 64, 66, 68, 70. In the embodiment shown, the troughs comprise shallow troughs 62, 66, 68, 70 and deep troughs 64. The troughs 62, 66, 68, 70 form a stop which support at least a portion of the biasing force and/or indexing force and/or counterforce at the respective first and/or second and/or third and/or fourth axial positions.

It will be appreciated that the pattern of peaks 51, 53, 54, 56, 58, 60 and troughs 62, 64, 66, 68, 70 is repeated circumferentially in the slot 38 corresponding to each guide pin 36. The relative path 80 of a guide pin 36 in the slot 38 is depicted by broken line. When the net axial biasing force acting on the indexing member 20 changes from downhole to uphole, the indexing member 20 moves axially and rotationally relative to the tubular member as defined by the path 80 from the first position 82 corresponding to FIG. 1 with the guide pin 36 in a first peak 51 to the second position 84 corresponding to FIG. 2 with the guide pin 36 in a first shallow trough 62. The balance piston 22 ensures that the guide pin 36 is not overloaded as the balance piston 22 supports the indexing member 20 at the second position 84 of FIG. 2.

Subsequently, when the net axial biasing force acting on the indexing member 20 changes from uphole to downhole, the indexing member 20 moves axially and rotationally relative to the tubular member as defined by the path 80 from the second position 84 corresponding to FIG. 2 with the guide pin 36 in a first shallow trough 62 to the third position 86 corresponding to FIG. 3 with the guide pin 36 in a second peak 53.

When the net axial biasing force acting on the indexing member 20 changes from downhole to uphole, the indexing member 20 moves axially and rotationally relative to the tubular member as defined by the path 80 from the third position 86 corresponding to FIG. 3 with the guide pin 36 in the second peak 53 to the fourth position 88 corresponding to FIG. 4 with the guide pin 36 in a first deep trough 64.

Subsequently, the net axial biasing force acting on the indexing member 20 may be changed from uphole to downhole, such that the indexing member 20 moves axially and rotationally relative to the tubular member as defined by the path 80 from the fourth position 88 corresponding to FIG. 4 with the guide pin 36 in the first deep trough 64 to a fifth position 90 corresponding to the axial position of FIG. 1 with the guide pin 36 in the third peak 54.

Accordingly, the indexing member 20 may be continuously endlessly cycled between rotational and axial positions relative to the tubular body 18.

One skilled in the art will appreciate that various modifications of the apparatus 16 are possible. For example, the coupling arrangement may differ from the indexing pin and slot arrangements described above. For example, the coupling arrangement may comprise a pair of inter-engaging members such as a pair of inter-engaging clutch members or a cam member and a cam follower member, wherein one or both of the inter-engaging members are configured so as to define sequential indexing positions within a cycle, each indexing position corresponding to an operational state or configuration.

Similarly in alternative embodiments, rather than being endlessly cycled in a clockwise or counter-clockwise direction, the indexing member may be endlessly cycled by repeatedly reversing the direction of rotation.

In the embodiment shown, the indexing member is subjected to downhole or annular pressure (via a chamber comprising the spring) from a radial port. However, it will be appreciated that in other embodiments, the actuation member may be subjected to a downhole or annular pressure from an axial port or throughbore. For example, the downhole tool may be at least selectively open at a downhole end.

In alternative embodiments the indexing member may be indexed between positions using one or more motor/s, such as hydraulic or electric motor/s, in addition or as an alternative to the fluid pressure propulsion or biasing of the embodiment shown. The provision of the balance piston may enable the use of a smaller motor/s or fewer motors than may otherwise be required to overcome a differential pressure acting on the indexing member.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. It should be understood that the embodiments described herein are merely exemplary and that various modifications may be made thereto without departing from the scope of the invention.

For example, it will be appreciated that the indexing member may be cycled or indexed without substantially varying the cycling or indexing force or pressure. For example, the indexing force or indexing chamber pressure may be defined or linked to a substantially constant force or pressure, such as an annular fluid pressure or a constant bore pressure or a resilient member. The indexing member may be cycled or indexed by varying the biasing force and/or balance piston force.

It will be appreciated that the balance piston may act as a safety mechanism, such as in the event that the apparatus is inadvertently indexed or cycled. For example, where an unplanned or sudden change in fluid pressure occurs, such as due to a pump failure or shut-off, the balance piston ensures that the coupling arrangement is not subjected to an overload due to a substantially relatively high downhole or annular pressure.

It will be appreciated that where the balance piston shown here is uphole of the indexing member, in other embodiments, the balance piston may be located downhole of the indexing member. Similarly, where shown here as a single balance piston at least partially counteracting the biasing piston, in other embodiments an additional or alternative balance piston may at least partially counteract the indexing member. For example, the balance piston may be configured to counteract a force in an indexing chamber, such as an internal bore fluid. Such a balance piston may provide an alternative or additional biasing force, such that lower forces are transmitted to the coupling arrangement, such as at an alternative or a second intermediate position corresponding to the position of FIG. 3 (e. g. where FIG. 3 is replaced with an intermediate position, with the indexing member biased downhole, rather than an end axial position).

The invention claimed is:

1. A downhole indexing apparatus for cyclically varying a configuration or operational mode of a downhole tool according to a predetermined sequence, the apparatus comprising:

a tubular body including a throughbore;

an indexing member selectively moveable relative to the tubular body in response to a signal between a first axial position and a second axial position, wherein movement of the indexing member relative to the tubular body is defined by an indexing pin and slot coupling arrangement;

an indexing fluid chamber uphole of the indexing member, wherein the indexing fluid chamber is in fluid communication with the throughbore via an indexing chamber port; and wherein the signal for moving the indexing member comprises change in a differential fluid pressure acting across the indexing member;

the apparatus further comprising a balance piston for supporting the indexing member at at least one of the axial positions;

wherein the indexing member is selectively movable between the first axial position and the second axial position in response to the signal, the second position comprising the supported position, and wherein the balance piston is configured to move from a passive position to an active position to support the indexing member at the second position;

wherein the indexing member is biased towards the supported position by a biasing force, and the balance piston is configured to at least partially counteract the biasing force when the indexing member is in the supported position;

wherein the balance piston is configured to engage or contact the indexing member at the second position, thereby reducing load on the indexing member and consequently the indexing pin.

2. The apparatus of claim 1, wherein the biasing force provides a preload at the supported position, maintaining the indexing member in the supported position, and wherein the balance piston is configured to reduce the preload at the supported position.

3. The apparatus of claim 1, wherein the biasing force comprises a fluid pressure force component, and the balance piston is configured to at least partially counteract the biasing force's fluid pressure force component.

4. The apparatus of claim 1, wherein the apparatus is configured to expose the balance piston to a similar fluid pressure as the biasing force's fluid pressure, and wherein the apparatus is configured to propel the balance piston towards the active position and the indexing member from the unsupported or first position towards the supported or second position with fluid from a same source.

5. The apparatus of claim 1, wherein the indexing fluid chamber is intermediate the biasing fluid chamber and the balance piston fluid chamber.

6. The apparatus of claim 1, further comprising a coupling arrangement for controlling movement of the indexing member, wherein the coupling arrangement comprises a protrusion and a slot, wherein the protrusion engages the slot.

7. The apparatus of claim 6, wherein the slot is configured to allow the balance piston to support at least at a portion of the biasing force and/or indexing force and/or counterforce at the first and/or second and/or third and/or fourth axial positions.

* * * * *